US007558512B2

(12) United States Patent
Choi et al.

(10) Patent No.: US 7,558,512 B2
(45) Date of Patent: Jul. 7, 2009

(54) TONER CARTRIDGE AND ELECTROPHOTOGRAPHIC PRINTER EMPLOYING THE SAME

(75) Inventors: Sam-seok Choi, Suwon-si (KR); Dong-hoon Park, Osan-si (KR); Myoung-su Baek, Suwon-si (KR); Seung-yoon Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/060,458

(22) Filed: Apr. 1, 2008

(65) Prior Publication Data

US 2008/0187367 A1 Aug. 7, 2008

Related U.S. Application Data

(62) Division of application No. 10/964,651, filed on Oct. 15, 2004, now Pat. No. 7,373,098.

(30) Foreign Application Priority Data

Oct. 20, 2003 (KR) ..... 2003-73180
Oct. 20, 2003 (KR) ..... 2003-73181
Oct. 20, 2003 (KR) ..... 2003-73182

(51) Int. Cl.
*G03G 15/01* (2006.01)

(52) U.S. Cl. ..... 399/223

(58) Field of Classification Search ..... 399/223, 399/298, 302

See application file for complete search history.

(56) References Cited

U.S. PATENT DOCUMENTS 4,591,261 A * 5/1986 Saruwatari et al. ..... 399/223
4,682,880 A * 7/1987 Fujii et al. ..... 399/302
4,878,091 A * 10/1989 Morita et al.
4,910,535 A * 3/1990 Yoshino et al.
4,954,844 A * 9/1990 Morita et al. ..... 399/223
4,996,566 A * 2/1991 Morita et al.
4,998,145 A * 3/1991 Haneda et al.
5,041,876 A * 8/1991 Kusuda
5,539,507 A * 7/1996 Miyashiro et al. ..... 399/298

(Continued)

FOREIGN PATENT DOCUMENTS

EP 0938033 8/1999

(Continued)

*Primary Examiner*—Susan S Lee
(74) *Attorney, Agent, or Firm*—Stanzione & Kim LLP

(57) ABSTRACT

A toner cartridge horizontally installed in an electrophotographic printer having a photoreceptor drum where an electrostatic latent image is formed by charging and exposure, and contributing to toner supply and development by being fixedly coupled to in the electrophotographic printer. The toner cartridge includes a housing filled with toner of a predetermined color, a development roller rotatably installed on the housing to face the photoreceptor drum and to supply the toner to the photoreceptor drum to develop an image by a difference in electrical potential, a supply roller rotatably installed in the housing in contact with the development roller and to control the toner to adhere to the development roller, and a guide member coupled to the housing to be disposed under the supply roller and to guide supply of the toner. When a diameter of the development roller is $D_2$, the diameter $D_2$ satisfies an inequality that $10.4 \leqq D_2 \leqq 22.1$ mm.

18 Claims, 7 Drawing Sheets

U.S. PATENT DOCUMENTS 5,541,722 A * 7/1996 Ikeda et al. ..... 399/223
5,663,787 A * 9/1997 Haneda et al.
5,671,464 A * 9/1997 Kubota ..... 399/302
5,778,291 A * 7/1998 Okubo et al. ..... 399/302
5,781,838 A 7/1998 Suzuki
5,815,775 A * 9/1998 Miyasaka et al. ..... 399/223
5,832,350 A 11/1998 Kumasaka et al.
5,873,017 A * 2/1999 Soga et al. ..... 399/302
5,899,610 A * 5/1999 Enomoto et al. ..... 399/302
6,085,051 A * 7/2000 Miyasaka et al.
6,163,669 A 12/2000 Aoki et al.
6,343,201 B1 1/2002 Wada et al.
RE38,026 E 3/2003 Tada et al.
2002/0142243 A1 10/2002 Hirose et al.
2003/0113139 A1 6/2003 Yasukawa et al.

FOREIGN PATENT DOCUMENTS

JP 63286872 A * 11/1988
JP 09-096972 4/1997
JP 10-115981 5/1998
JP 10115963 A * 5/1998
JP 10-198113 7/1998
JP 10186780 A * 7/1998
JP 10-268584 9/1998

* cited by examiner

TONER CARTRIDGE AND ELECTROPHOTOGRAPHIC PRINTER EMPLOYING THE SAME

CROSS-REFERENCE TO RELATED APPLICATIONS

This application is a divisional application of Ser. No. 10/964,651, filed Oct. 15, 2004, now U.S. Pat. No. 7,373,098 which claims the priorities of Korean Patent Application Nos. 2003-73180, 2003-73181, and 2003-73182, filed on Oct. 20, 2003, in the Korean Intellectual Property Office, the disclosure of which are incorporated herein in their entirety by reference.

BACKGROUND OF THE INVENTION

1. Field of the Invention

The present general inventive concept relates to a toner cartridge to supply toner to an electrophotographic printer to contribute to development, and an electrophotographic printer employing the same, and more particularly, to a horizontal installation type fixed toner cartridge in which a specification of the toner cartridge, the arrangement and specification of the toner cartridge with respect to a photoreceptor drum, and specifications of the photoreceptor drum and a development roller are optimized, and an electrophotographic printer employing the same.

2. Description of the Related Art

In general, electrophotographic printers form an electrostatic latent image by scanning light onto a photosensitive medium to charge to a predetermined electric potential, and the electrostatic latent image is developed by a predetermined color toner. The developed image is transferred to a print paper and fused thereon so that an image is printed.

The electrophotographic printer can be divided into a wet type electrophotographic printer and a dry type electrophotographic printer according to a developer. The wet type electrophotographic printer uses a developer made by mixing a liquid carrier and toner powder. The dry type electrophotographic printer uses a dual component developer made by mixing a powder carrier and a toner or a single component developer excluding carrier.

Also, the electrophotographic printer can be divided into a black and white printer and a color printer according to the presence of realization of color. The black and white printer uses a single toner cartridge having a black color. The color printer uses four toner cartridges having yellow, magenta, cyan, and black colors to supply toner and perform development. Also, the color printer can be divided into a single pass type color printer and a multi-pass type color printer according to a color image realization manner.

The single pass type color printer adopts exposure units and chargers corresponding to four color development units with respect to a single photosensitive medium. The single pass type color printer prints a color image by one turn of the photosensitive medium. Thus, for color printing, a high speed printing is possible at the same speed as that for printing a mono color image. However, by adopting a plurality of exposure units and chargers, a structure of the single pass type color printer becomes complicated, and a manufacturing cost increases.

The multi-pass type color printer adopts a single exposure unit and a single charger and four development units for developing each color. The multi-pass type color printer prints a full color image by four turns of the photosensitive medium. Accordingly, a print time is theoretically four times longer than that of the single pass type color printer. However, since the single exposure unit and the single charger are employed, a structure of the printer becomes simplified, and a manufacturing cost is reduced.

The above descriptions are disclosed in U.S. patent application Ser. No. 10/620,768, entitled a color image forming apparatus and a color image forming method and filed on Jul. 17, 2003 by the present applicants and in U.S. patent application Ser. No.: 10/822,004, entitled an electrophotographic printer and filed on Apr. 12, 2004 by the present applicants.

The electrophotographic printer adopts a multi-pass type. In a structure of the electrophotographic printer, a toner cartridge corresponding to each color is horizontally installed with respect to a printer main body and is fixed with respect to the printer main body during printing.

In this structure, a plurality of toner cartridges contributing to development are fixed in the electrophotographic printer. Thus, compared to a printer adopting a conventional toner cartridge, noise and vibration generated during its operation can be fundamentally removed. Also, by omitting a structure to slide or rotate a development unit, the structure thereof can be simplified and a manufacturing cost can be reduced.

In the meantime, in a printer adopting a horizontal installation type fixed toner cartridge, considering a print quality improvement, a compact structure, a reduction of an assembly step, and a reduction of a manufacturing cost, it is required to optimize a height of each toner cartridge, a total effective height of the entire toner cartridges, an opening angle of a development roller, and the specification of the photosensitive medium into values within a predetermined range. Furthermore, it is required to specify the arrangement structure of the toner cartridges.

SUMMARY OF THE INVENTION

To solve the above and/or other problems, it is an aspect of the present general inventive concept to provide a horizontal installation type fixed toner cartridge with which specifications of a toner cartridge and a photosensitive medium are optimized.

It is another aspect of the present general inventive concept to provide a dry type electrophotographic printer of a multi-pass type adopting a horizontal installation type fixed toner cartridge with which a specification of a photosensitive medium is optimized.

Additional aspects and advantages of the present general inventive concept will be set forth in part in the description which follows and, in part, will be obvious from the description, or may be learned by practice of the general inventive concept.

The above and/or other aspects of the present general inventive concept may be achieved by providing a toner cartridge that is horizontally installed in an electrophotographic printer having a photoreceptor drum where an electrostatic latent image is formed by charging and exposure, and contributes to toner supply and development by being fixed in the electrophotographic printer, the toner cartridge including a housing filled with toner of a predetermined color, a development roller rotatably installed on the housing to face the photoreceptor drum and supplying the toner to the photoreceptor drum and developing an image by a difference in electrical potential, a supply roller rotatably installed in the housing in contact with the development roller and to control the toner to adhere to the development roller, and a guide member coupled to the housing to be disposed under the supply roller and to guide supply of the toner, wherein, when a diameter of the development roller is $D_2$, the diameter $D_2$ satisfies an inequality that $10.4 \leqq D_2 \leqq 22.1$ [mm].

The above and/or other aspects of the present general inventive concept may also be achieved by providing an electrophotographic printer including a cabinet, a photoreceptor drum on which an electrostatic latent image is formed by charging and exposure, and a toner cartridge which is installed horizontally in the cabinet and supplies toner in a state of being fixed in the cabinet, the toner cartridge including a development roller which is rotatably installed to face the photoreceptor drum and develops an image on the photoreceptor drum, wherein, when a diameter of the photoreceptor drum is $D_1$, the diameter $D_1$ satisfies an inequality that $116 \leqq D_1 \leqq 130$ [mm].

The above and/or other aspect of the present general inventive concept may also be achieved by providing, an electrophotographic printer including a cabinet, a photoreceptor drum provided in the cabinet and formed with an electrostatic latent image by charging and exposure, and a plurality of toner cartridges which supplies toner of a predetermined color to the photoreceptor drum in a state of being fixed in the cabinet, each of the toner cartridges including a development roller which is arranged to face the photoreceptor drum to develop an image, wherein an angle formed between a first line connecting a center of the development roller of the toner cartridge disposed at an uppermost side and a center of the photoreceptor drum and a second line connecting a center of the development roller of the toner cartridge disposed at a lowermost side and the center of the photoreceptor drum is $\theta_4$ and the angle $\theta_4$ is within 180°.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
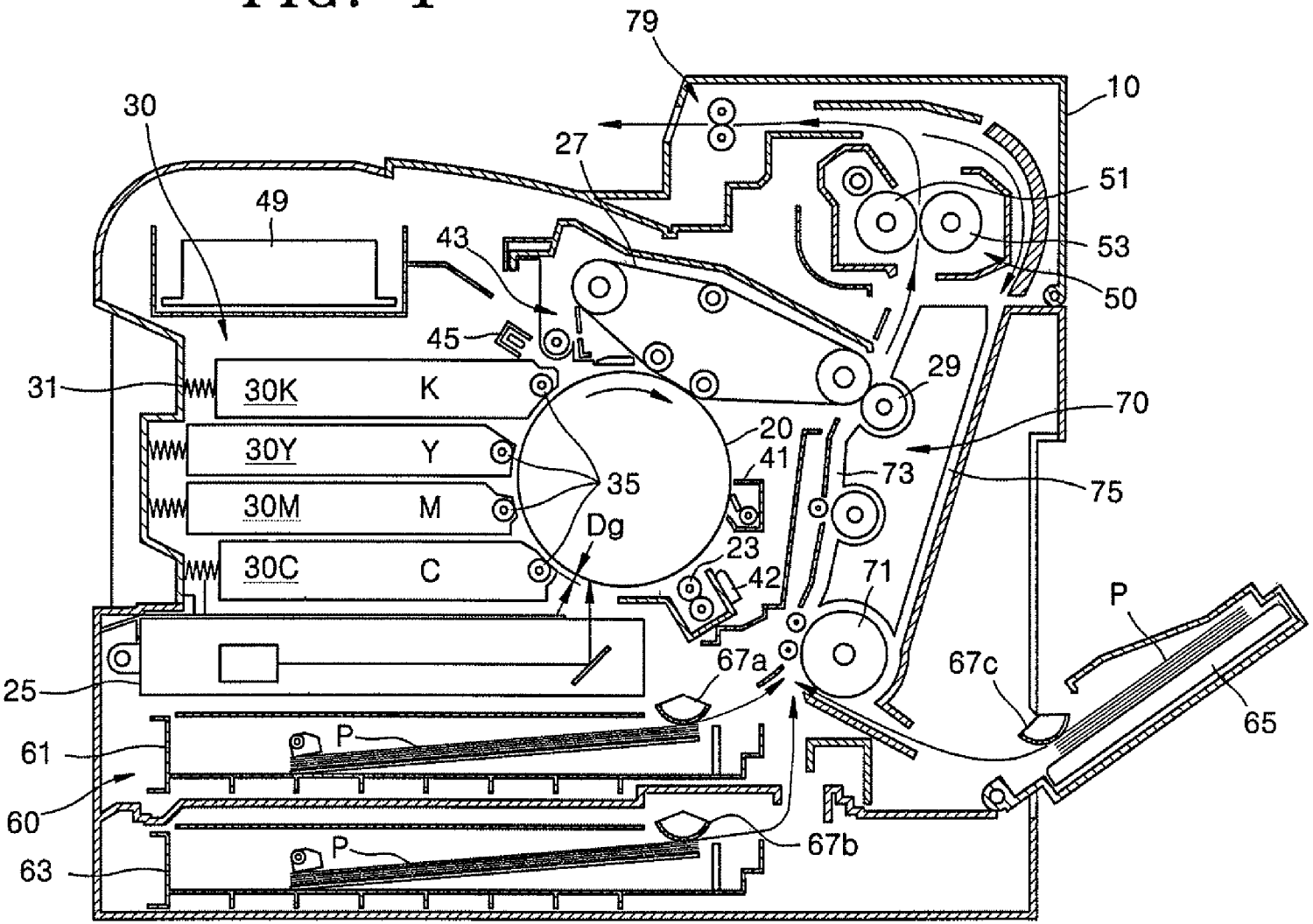
FIG. 1 is a view illustrating an internal structure of an electrophotographic printer adopting a toner cartridge according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Referring to FIG. 1, an electrophotographic printer according to an embodiment of the present invention can include a cabinet 10, a photoreceptor drum 20, a charge roller 23, an exposure unit 25, a transfer belt 27, and a toner supply unit 30.

The photoreceptor drum 20 can include a cylindrical metal drum and a photoconductive layer formed on an outer circumferential surface thereof.

The charge roller 23 is an example of a charger which charges the photoreceptor drum 20 to a uniform electric potential. The charge roller 23 can supply charges while rotating in a state of contacting or not contacting the photoreceptor drum 20, so that the photoconductive layer of the photoreceptor drum 20 has the uniform electric potential. A corona charger (not shown) may be used as the charger instead of the charge roller 23.

The exposure unit 25 can be installed under the photoreceptor drum 20 and can scan light onto the photoreceptor drum 20 which is charged to the uniform electric potential to form an electrostatic latent image corresponding to image information. A laser scanning unit (LSU) is an example of the exposure unit 25. The LSU can generally use a laser diode as a light source, can scan light emitted from the light source via a rotary polygonal mirror or a hologram disc, and can condense a beam emitted through an f-θ lens.

The toner supply unit 30 can include four toner cartridges 30C, 30M, 30Y, and 30K which respectively contain solid powder toners of cyan (C), magenta (M), yellow (Y), and black (K) colors. Each toner cartridge can include a development roller 35 which supplies toner to the photoreceptor drum 20 to form a toner image with respect to the electrostatic latent image formed on the photoreceptor drum 20. Each toner cartridge can be fixedly installed in the cabinet 10 and can be pressed toward the photoreceptor drum 20 by an elastic pressing unit 31 which is not operated during development. The development can be performed in a non-contact manner so that a development gap Dg of several tens through hundreds microns is formed between the development roller 35 and the photoreceptor drum 20.

When the toner cartridges 30C, 30M, 30Y, and 30K perform the development with respect to the photoreceptor drum 20, only one development roller 35 of the toner cartridge 30C, 30M, 30Y, or 30K corresponding to one color can contribute to the development during one turn of the photoreceptor drum 20.

The transfer belt 27 can receive the image developed on the photoreceptor drum 20 and can transfer the same to a print paper P. The toner images of the respective colors sequentially formed on the photoreceptor drum 20 can be sequentially transferred to the transfer belt 27 to be overlapped so that a full color image is formed. A length of the transfer belt 27 may not be less than that of the print paper P having a largest size among print papers.

The electrophotographic printer can further include a pressing roller 29, first and second cleaning units 41 and 43, a pre-transfer eraser unit 45, an eraser lamp 42, a power supplier 49, a fusing unit 50, and a paper feed unit 60.

The pressing roller 29 can be installed to face the transfer belt 27. The pressing roller 29 can be separated from the transfer belt 27 when the color image is transferred to the transfer belt 27. When the color image is completely transferred to the transfer belt 27, the pressing roller 29 can contact the transfer belt 27 at a predetermined pressure. The transferred image can be retransferred to the print paper P.

The first cleaning unit 41 can remove waste toner remaining on the outer circumferential surface of the photoreceptor drum 20 after the color image is transferred to the transfer belt 27. The second cleaning unit 43 can also remove waste toner remaining on the transfer belt 27 after the image on transfer belt 27 is retransferred to the print paper P.

The pre-transfer eraser unit 45 can remove electric charges from a non-image area of the photoreceptor drum 20 where the color image is not formed, before the toner image developed on the photoreceptor drum 20 is transferred to the transfer belt 27. Accordingly, an efficiency in transfer of the image from the photoreceptor drum 20 to the transfer belt 27 can be improved.

The eraser lamp 42 can remove the electric charges remaining on the outer circumferential surface of the photoreceptor drum 20 before charging the photoreceptor drum 20. That is, the eraser lamp 42 can remove the electric charges remaining on the outer circumferential surface of the photoreceptor drum 20 by radiating a predetermined amount of light onto the outer circumferential surface of the photoreceptor drum 20.

The power supplier 29 can provide a development bias power, a development prevention bias power, first and second transfer bias power, and a charge bias power. The development bias power is used to develop an image with the toner from each toner cartridge that contributes to the development to the photoreceptor drum 20. The development prevention bias power can prevent the development of the image with the toner provided from any toner cartridge that does not contribute to the development to the photoreceptor drum 20.

The first transfer bias power can be used to transfer the toner image from the photoreceptor drum 20 to the transfer belt 27. The second transfer bias power can be used to transfer the toner image from the transfer belt 27 to the print paper P. The charge bias power can be applied to the charge roller 23.

The fusing unit 50 to fuse the toner image transferred to the print paper P can include a pair of fusing rollers 51 and 53 rotating in contact with each other at a predetermined pressure. At least one of the fusing rollers 51 and 53 may have a heating unit (not shown). Thus, as the print paper P to which the toner image is transferred passes between the fusing rollers 51 and 53 of the fusing unit 50, the toner image can be fused on the print paper P by heat and pressure.

The paper feed unit 60 may have a space where the print paper P is contained. The paper feed unit 60 can include a first paper feed cassette 61 slidably installed inside the cabinet 10. The paper feed unit 60 may further include a second paper feed cassette 63 to contain the print paper P and/or a multipurpose feeder (MPF) 65. The MPF 65 can mainly be used to supply OHP films or non-standard print papers. The print paper P contained in the first and second paper feed cassettes 61 and 63 and the MPF 63 can be transferred by pickup rollers 67*a*, 67*b*, and 67*c*.

The print paper P supplied through the paper feed unit 60 can pass through a paper transfer unit 70 and can be transferred to a path between the transfer belt 27 and the pressing roller 29. The paper transfer unit 70 can include a feed roller 71, a paper feed path 73 which guides the print paper P to be transferred between the feed roller 71 and the fusing unit 50, and a duplex path 75 which guides reverse transfer of the print paper P for both-side print. The print paper on which an image is finally printed can be exhausted outside a cabinet 10 through the exhaust roller 79.

A printing process of the electrophotographic printer having the above structure according to an aspect of the present general inventive concept is described below.

Color printing can be embodied on a print paper with basic colors, such as cyan (C), magenta (M), yellow (Y), and black (K) colors, by overlapping them in a predetermined ratio. In this embodiment, toner images of the respective colors can be overlapped on the transfer belt 27 in order of cyan (C), magenta (M), yellow (Y), and black (K) colors and transferred to the print paper P. Then, the image is fused by the fusing unit 50 so that a color print is performed.

The outer circumferential surface of the photoreceptor drum 20 can be charged to a predetermined electric potential by the charge roller 23. Next, when the exposure unit 25 scans an optical signal corresponding to image information of the cyan (C) color onto the photoreceptor drum 20 that is rotating, a resistance of a portion where the light is scanned decreases, and charges escape from the photoreceptor drum 20. Thus, as a difference in electric potential is generated between the portion where the light is scanned and a portion where the light is not scanned, the electrostatic latent image is formed on the outer circumferential surface of the photoreceptor drum 20.

While the photoreceptor drum 20 rotates, the electrostatic latent image can approach the cyan toner cartridge 30C, and the development roller 35 of the cyan toner cartridge 30C starts to rotate. The power supplier 49 can apply the development bias power to the development roller 35 of the cyan toner cartridge 30C. The development prevention bias power to prevent the development can be applied to the development rollers 35 of the other toner cartridges 30M, 30Y, and 30K. Then, the image can be developed with only the cyan color toner on the outer circumferential surface of the photoreceptor drum 27 through the development gap Dg.

The toner image of the cyan (C) color can approach the transfer belt 27 by the rotation of the photoreceptor drum 20 so that the image is transferred to the transfer belt 27.

When the toner image of the cyan (C) color is completely transferred to the transfer belt 27, the toner images of the magenta (M), yellow (Y), and black (K) colors can be sequentially transferred to the transfer belt 27 to overlap thereon. As the respective colors are overlapped, the full color image is formed.

During the above process, the pressing roller 29 can be separated from the transfer belt 27. When the full color image is formed on the transfer belt 27, the pressing roller 29 can press the transfer belt 27 with the print paper P interposed therebetween, so that the image is retransferred to the print paper P.

To this end, in order for a leading end of the color toner image formed on the transfer belt 27 to arrive on time at a position where the transfer belt 27 contacts the pressing roller 29, the print paper P can be supplied from the paper feeding unit 60 so that a leading end of the print paper P arrives at the position where the transfer belt 27 contacts the pressing roller 29. As the print paper P passes between the transfer belt 27 and the pressing roller 29, the full color image can be retransferred to the print paper P by the second transfer bias power. Next, the full color image can be fused on the print paper P by heat and pressure by the fusing unit 50 and exhausted outside so that the color print is completed. Thereafter, the first and second cleaning apparatuses 41 and 43 remove the waste toner remaining on the photoreceptor drum 20 and the transfer belt 27, respectively. The eraser lamp 42 can scan light onto the photoreceptor drum 20 to remove charges remaining on the photoreceptor drum 20.

In the electrophotographic printer having the above structure according to an aspect of this embodiment, each of the color toner cartridges 30C, 30M, 30Y, and 30K can be installed in an inside the cabinet 10 in a horizontal direction.

Figure 2:
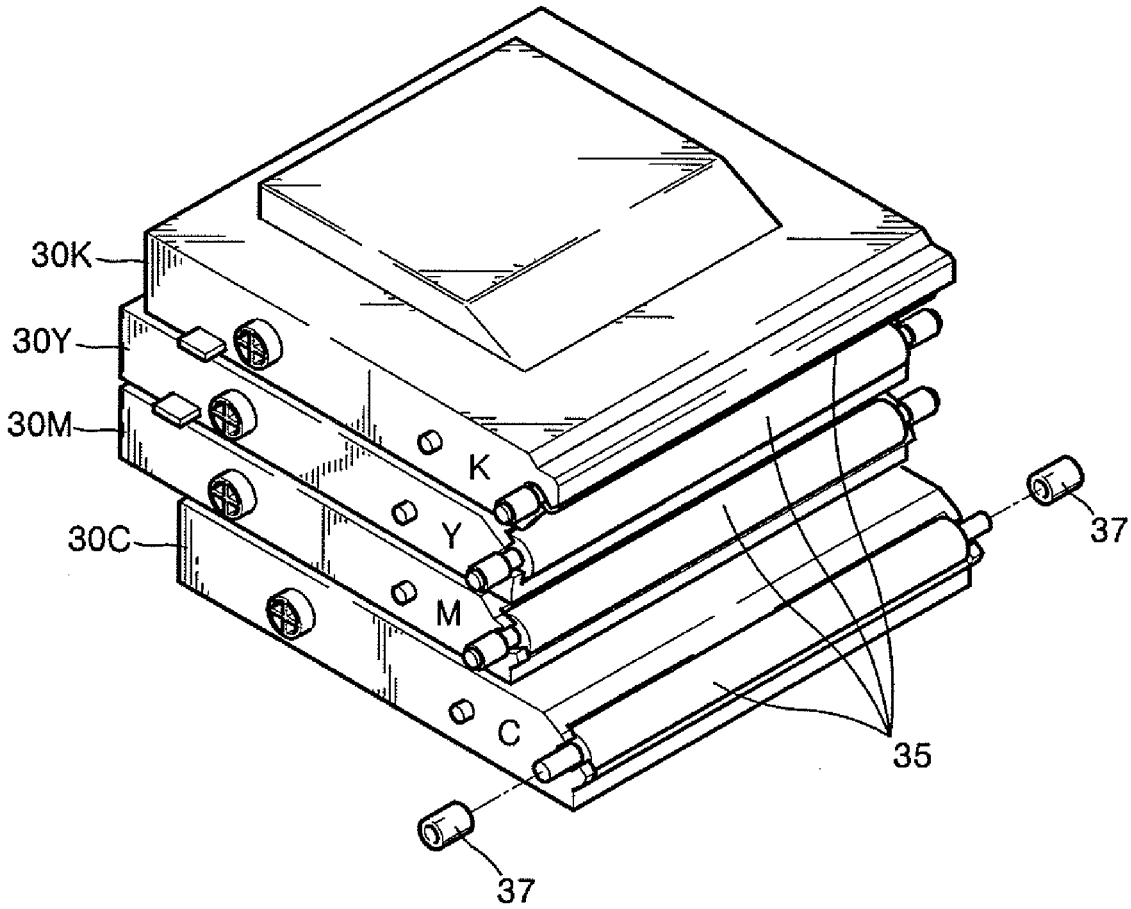
FIG. 2 is a perspective view illustrating the arrangement of four toner cartridges according to another embodiment of the present general inventive concept.
Figure 3:
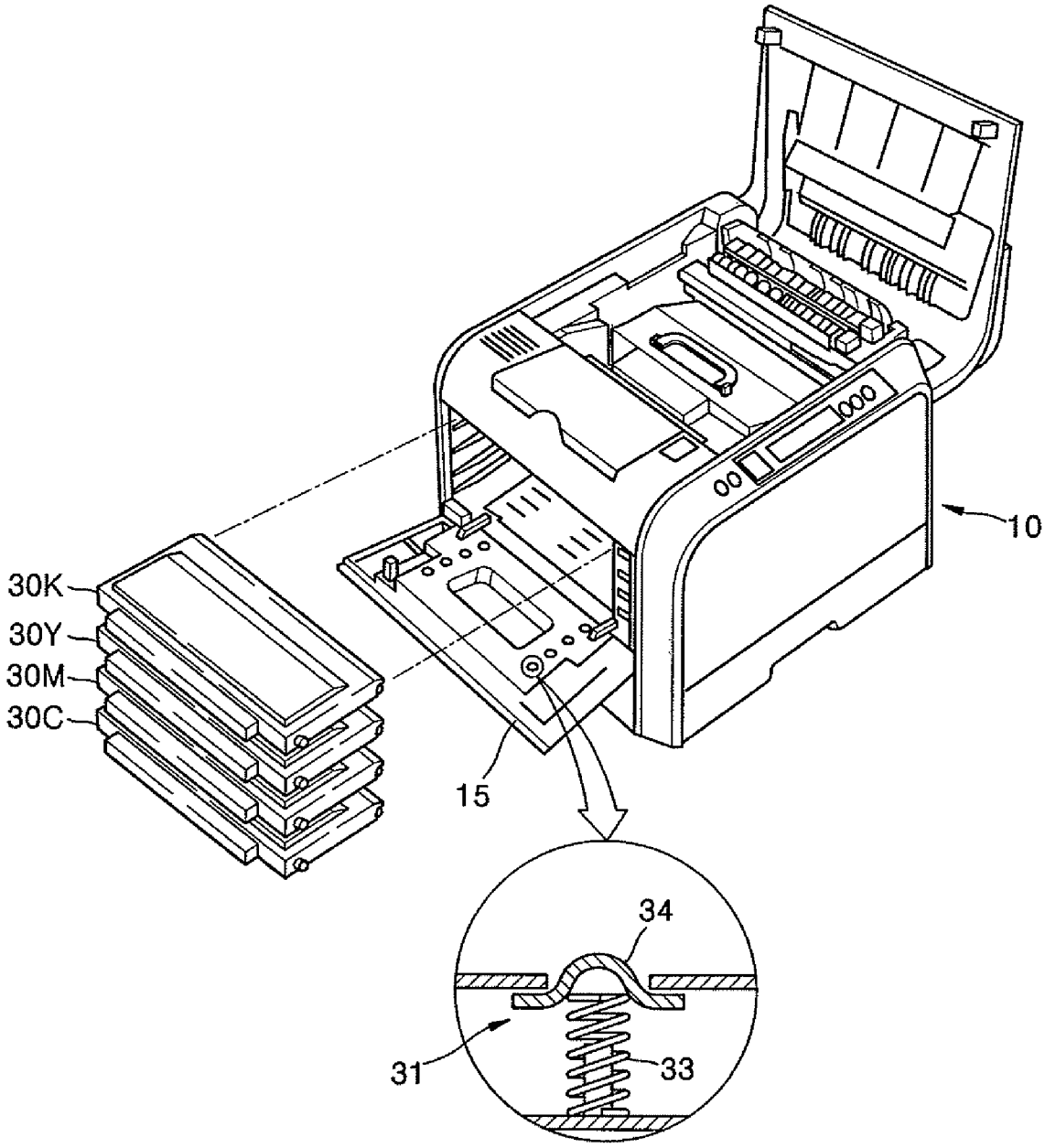
FIG. 3 is a perspective view illustrating the installation of the four toner cartridges in the electrophotographic printer as shown in FIGS. 1 and 2.

Referring to FIGS. 2 and 3, the four toner cartridges 30C, 30M, 30Y, and 30K can be stacked in layers in order of the cyan toner cartridge 30C, the magenta toner cartridge 30M, the yellow toner cartridge 30Y, and the black toner cartridge 30K from the bottom to the upper side. Toners of cyan (C), magenta (M), yellow (Y), and black (K) colors can be contained in the four toner cartridges 30C, 30M, 30Y, and 30K, respectively. Each of the toner cartridges 30C, 30M, 30Y, and 30K can include the development roller 35 which supplies the toner contained in each toner cartridge to the photoreceptor drum 20 of FIG. 1. A gap ring 37 can be provided at both ends of each development roller 35. The gap ring 37 can maintain the development gap Dg between the development roller 35 and the photoreceptor drum 20 and may have a diameter larger than that of the development roller 35. Thus, when the toner cartridges 30C, 30M, 30Y, and 30K are installed, the gap ring 37 can contact the outer circumferential surface of the photoreceptor drum 20 to stop the toner cartridges 30C, 30M, 30Y, and 30K, so that the development gap Dg is maintained between the development roller 35 and the photoreceptor drum 20.

The four toner cartridges 30C, 30M, 30Y, and 30K can be installed in the horizontal direction in a state in which a door 15 provided at a side wall of the cabinet 10 is open. After the installation is completed, the printing process can be performed in a state in which the four toner cartridges 30C, 30M, 30Y, and 30K are fixedly coupled to the cabinet 10.

To this end, the elastic pressing unit 31 to elastically press each of the toner cartridges 30C, 30M, 30Y, and 30K toward the photoreceptor drum 20 may be formed on an inner side of the door 15 in a closed state. In this case, the elastic pressing unit 31 can include an elastic member 33, such as a compression spring, and a pressing member 34 which is elastically biased by the elastic member 33 and can contact a rear side of each of the toner cartridges 30C, 30M, 30Y, and 30K to press the same. The elastic pressing unit 31 is not limited to an example shown in FIG. 3, and a variety of modified structures thereof can be used as the elastic pressing unit 31.

As described above, the horizontal installation type fixed toner cartridge and the electrophotographic printer adopting the same can require optimal specifications to meet conditions such as a print quality improvement, a compact structure, a reduction in the number of assembly operations, and a reduction of a manufacturing cost.

In this regard, the horizontal installation type fixed toner cartridge and the electrophotographic printer adopting the same can require optimal specifications to provide an improvement of the print quality, the compact structure, the reduction of the number of assembly operations, and the reduction of the manufacturing cost.

To this end, a height of each of the toner cartridges 30C, 30M, 30Y, and 30K, a total effective height of the entire toner cartridges, an opening angle and a diameter of the development roller 35, a diameter of the photoreceptor drum 20, and a relationship between the photoreceptor drum 20 and the development roller 35 will be explained below, and the optimal specifications according thereto will be described in detail hereinafter.

Figure 4:
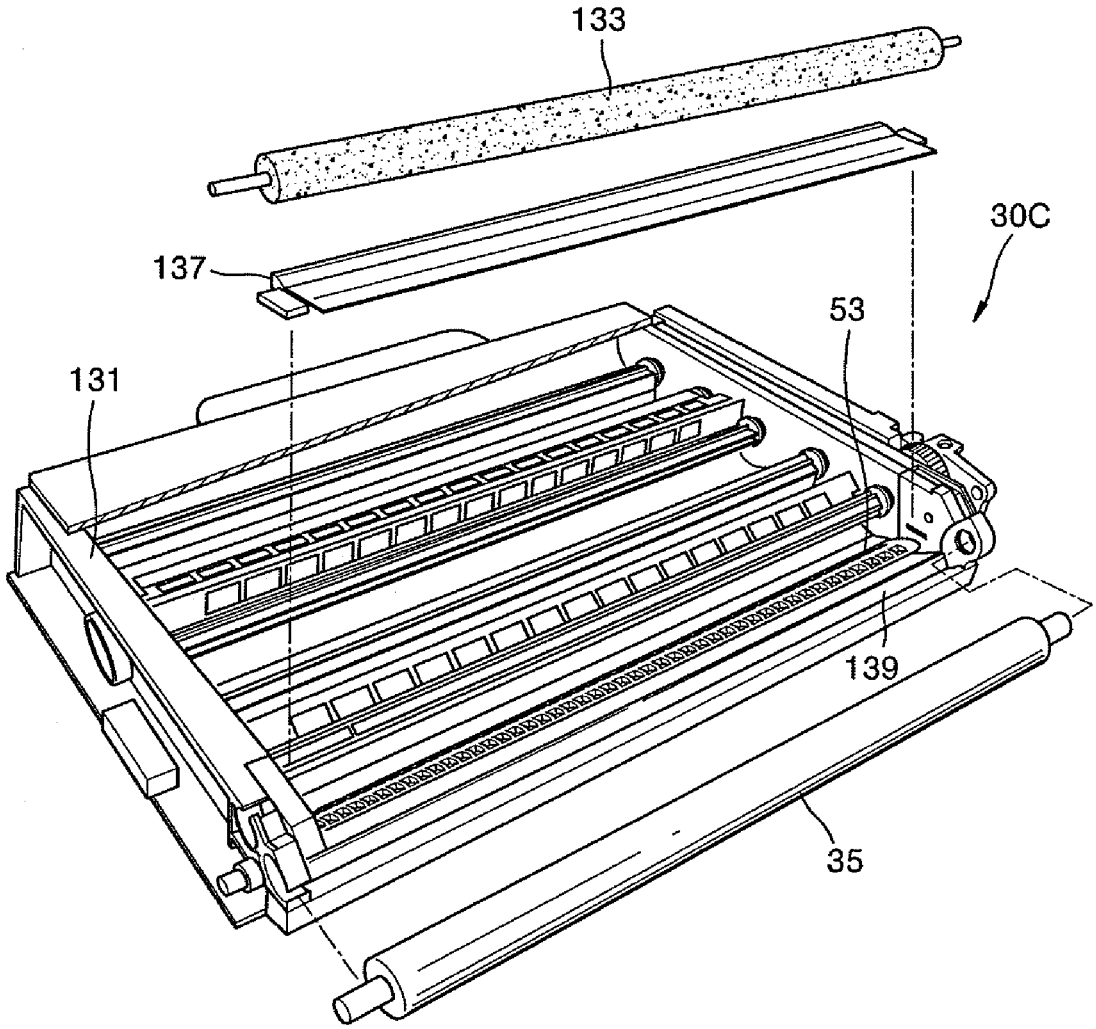
FIG. 4 is an exploded perspective view illustrating one of the four toner cartridges as shown in FIG. 2.
Figure 5:
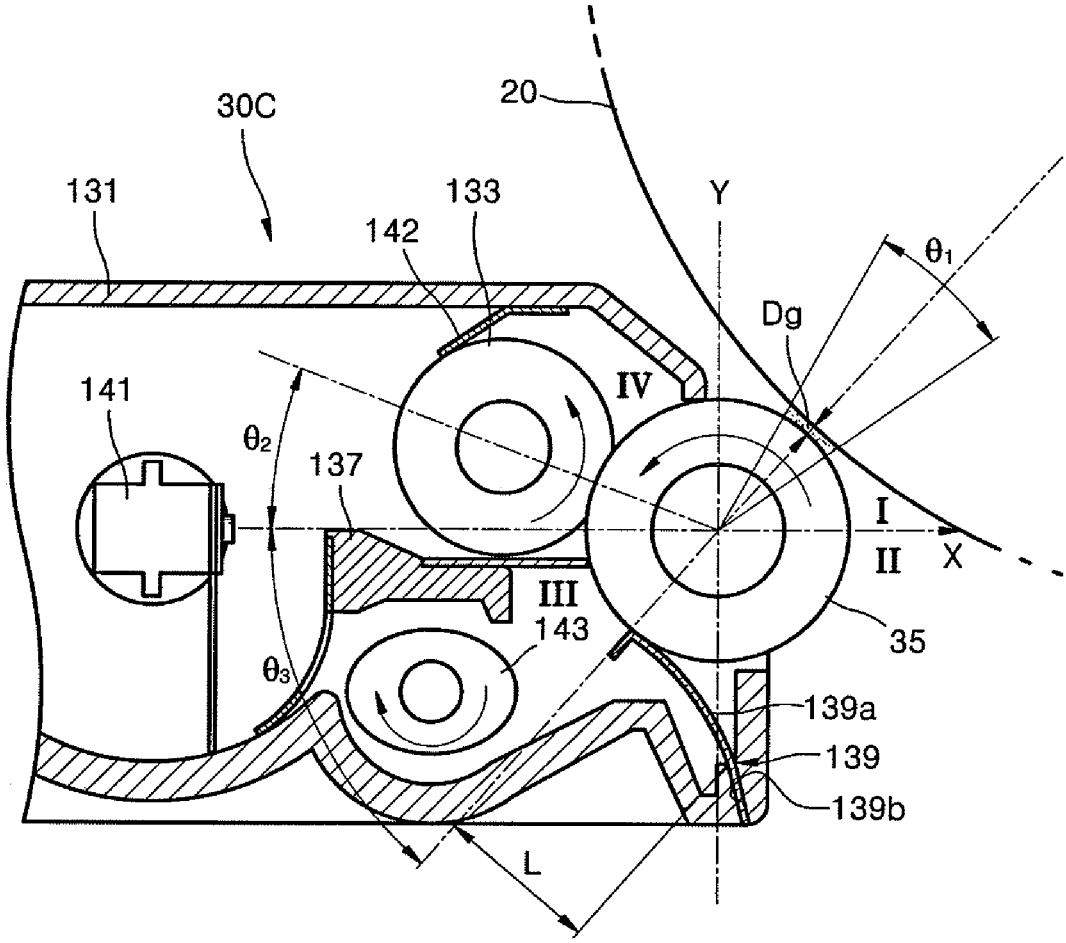
FIG. 5 is a view illustrating a part of the toner cartridge of FIG. 4.

Referring to FIGS. 4 and 5, each of the toner cartridges 30C, 30M, 30Y, and 30K can include a housing 131, the development roller 35, a guide member 137 to guide supply of toner, a supply roller 133, and a regulating blade 139. FIGS. 4 and 5 show the toner cartridge 30C for cyan (C) color, for example.

The development roller 35 can be rotatably installed on the housing 131 and can have a surface partially exposed outside the housing 131. The development roller 35 can supply toner to the photoreceptor drum 20 to develop an image by a difference in electrical potential.

A relationship between the photoreceptor drum 20 and the development roller 35 can satisfy conditions of Inequalities 1 and 2.

$$116 \leqq D_1 \leqq 130 \text{ [mm]} \qquad \text{[Inequality 1]}$$

where $D_1$ is a diameter of the photoreceptor drum 20.

The condition of Inequality 1 indicates a minimum space needed for installation of the toner cartridges 30C, 30M, 30Y, and 30K in a horizontal state and controlling each development roller 35 to face the photoreceptor drum 20. That is, in Inequality 1, when a value of the diameter $D_1$ is set to be less than a given lower limit value, it is difficult to arrange the toner cartridges 30C, 30M, 30Y, and 30K and secure an effective development gap Dg.

Also, when the diameter $D_1$ is set, jitter and color should be matched when the toner image is transferred to the transfer belt (27 of FIG. 1). That is, the diameter $D_1$ may be formed such that a length of the outer circumference of the photoreceptor drum 20 is identical to the length of the transfer belt 27.

In the transfer belt 27, an effective length contributing to the image transfer is set to be about 370 mm or more so that the printing process can be performed with respect to the print paper P, for example, an A4 size paper (210×297 mm), a legal size paper (8.5×14 inches), a B4 size paper (257×364 mm). Thus, according to the length of the transfer belt 27, the diameter $D_1$ of the photoreceptor drum 20 can be set within a range set by Inequality 1.

In Inequality 1, considering that the diameter $D_1$ is set to be over 130 mm, exposure and transfer process may not be influenced thereby. However, as the diameter $D_1$ is increased, a large space may be taken up, the manufacturing cost may be sharply raised, and a manufacturing process of the photoreceptor drum 20 may become difficult.

Also, when a diameter of the development roller 35 is $D_2$, a relationship between the diameters $D_1$ and $D_2$ can satisfy conditions of Inequality 2.

$$0.08 \leqq D_2/D_1 \leqq 0.17 \qquad \text{[Inequality 2]}$$

In an aspect of the present general inventive concept, the diameter $D_2$ of the development roller 35 can be 14 mm. In order for the development gap Dg to have a value of 0.2 mm, a diameter of the gap ring (37 of FIG. 2) can be set to 14.4 mm.

When the diameter $D_2$ is less than 10.4 mm so as to be out of a lower limit value of Inequality 2, printing over 5000 sheets with a standard of 5% coverage may not be possible without replacement of at least one of the toner cartridge 30C, 30M, 30Y, or 30K. When the diameter $D_2$ is over 22.1 mm so as to be out of an upper limit value of Inequality 2, the manufacturing cost of the development roller 35 can be sharply raised, and a mechanical arrangement can become difficult with respect to a maximum size of the photoreceptor drum 20.

Also, an opening angle $\theta_1$ of the development roller 35 may have a value of about 25±3 degrees.

The opening angle $\theta_1$ can be an angle formed between a line connecting a center of the development roller 35 and a leading end of the development gap Dg and a line connecting the center of the development roller 35 and a trailing end of the development gap Dg.

The opening angle $\theta_1$, as well as the diameter $D_2$, is a factor to determine the length of the development gap Dg. The opening angle $\theta_1$ can be determined according to a rotational linear velocity, the diameter $D_2$, and a bias electric potential applied to the development roller 35. When the opening angle $\theta_1$ is set within the above range, it is possible to perform full color printing over 4 sheets per minute.

As described above, by setting a specification range of the photoreceptor drum 20 and the development roller 35, a life span of the development roller 35 can be extended to print over 5000 sheets of print paper while a size thereof is minimized so that the manufacturing cost and the spatial arrangement of the printer can be optimized.

The supply roller 133 can rotate in contact with the development roller 35 and can be installed at a predetermined position in the housing 131 filled with toner of a predetermined color. The supply roller 133 can be formed of sponge so as to make the toner easily adhere to an outer surface thereof and have a large contact nip width with respect to the development roller 35.

The supply roller 133 can make the toner adhere to the development roller 35 and also can make a flow of supply of the toner smooth. For the smooth toner supply, a bias power of a predetermined electrical potential can be applied by the power supplier 49 of FIG. 1 to the supply roller 133. The toner being supplied can be charged to the predetermined electric potential by the bias power. The supply roller 133 can clean the toner remaining on the development roller 35 after development.

Hereinafter, settings of a size, a diameter and a rotation direction of the supply roller 133 and an arrangement position thereof according to a relationship with the development roller 35 will be described in detail.

The supply roller 133 can rotate in the same rotation direction as that of the development roller 35, that is, in a counterclockwise direction in FIG. 5. Thus, since the development roller 35 and the supply roller 133 rotate in opposite directions at a portion where the supply roller 133 contacts the development roller 35, the supply roller 133 can effectively perform a cleaning function. Also, the supply roller 133 has a diameter $D_3$ which satisfies conditions of Inequality 3.

$$11 \leqq D_3 \leqq 13 \text{ [mm]} \qquad \text{[Inequality 3]}$$

The diameter $D_3$ of the supply roller 133 can be set within the range of conditions of Inequality 3 since it is related to the diameter $D_2$ of the development roller 35 referred to in Inequalities 1 and 2. In this case, a width of the contact nip between the supply roller 133 and the development roller 35 may be secured over 3 mm. A linear speed of the supply roller 133 can be set to maintain at about 189 mm/sec and a linear speed of the development roller 35 can be set to be about 174 mm/sec, so that cleaning and charging processes are carried out.

That is, when the diameter $D_3$ is out of a lower limit value of Inequality 3, a rotation speed of the supply roller 133 may need to be increased to maintain a predetermined linear speed of the outer circumferential surface of the supply roller 133. When the above condition is not satisfied, the cleaning and chagrining processes may not be smoothly carried out. Meanwhile, when the diameter $D_3$ is out of an upper limit value, a space occupied by the supply roller 133 increases. Accordingly, a height of the housing 131 of the toner cartridge 30C increases, and thus a size of the photoreceptor drum 20 is affected thereby. Thus, a size of the entire printer and the manufacturing cost increase.

The arrangement of the supply roller 133 with respect to the development roller 35 is described below. Referring to FIG. 5, when coordinates of a horizontal axis (X axis) and a vertical axis (Y axis) are set to have first, second, third, and fourth quadrants 1, 2, 3, and 4 with respect to the center of the development roller 35, a center of the supply roller 133 can be disposed in the fourth quadrant IV. When an angle formed by a line connecting the centers of the development roller 35 and the supply roller 133 and the X axis is $\theta_2$, the angle $\theta_2$ can satisfy Inequality 4.

$$15° \leqq \theta_2 \leqq 25° \qquad \text{[Inequality 4]}$$

The angle $\theta_2$ may be about 21°. When the angle $\theta_2$ is out of an upper limit value of Inequality 4, collection of the toner through the supply roller 133 may not be smoothly performed and the height of the housing 131 increases. When the angle $\theta_2$ is out of a lower limit value of Inequality 4, it is not easy to secure a space between the guide member 137 and the supply roller 133 so that the toner supply flow is not formed.

The regulating blade 139 can regulate the amount of the toner supplied to the development gap Dg through the guide member 137, the supply roller 133, and the development roller 35. Also, the regulating blade 139 can prevent the toner filling the inside of the housing 131 from being exhausted through a portion where the development roller 35 is installed.

As shown in FIG. 5, a leading end of the regulating blade 139 can be disposed in the third quadrant III. When an angle formed by a line connecting the leading end of the regulating blade 139 and the center of the development roller 35 and the X axis is $\theta_3$, the angle $\theta_3$ can satisfy Inequality 5.

$$30° \leqq \theta_3 \leqq 50° \qquad \text{[Inequality 5]}$$

The angle $\theta_3$ may be 49°. When the angle $\theta_3$ is out of an upper limit value of Inequality 5, the leading end of the regulating blade 139 may move rotation of the development roller 35 to the second quadrant 11 of the coordinates so during a rotation of the development roller 35 that a function thereof may be lost. In contrast, when the angle $\theta_3$ is out of the upper limit value of Inequality 5, the toner that is not charged may be supplied to the development gap Dg through the supply roller 133 together with the charged toner.

The regulating blade 139 can contact the development roller 35 and can include a free end 139*a* having a degree of bending which is variable according to an external pressure and a fixed end 139*b* to fixedly couple the free end 139*a* to the housing 131. A pressure of a leading end of the free end 139*a* can be maintained at about 45 through 55 g/cm. A length L of the free end 139*a* has a value in a range between 8.5 and 9.2 mm. By setting the specification and arrangement of the regulating blade 139 as above, the free end 139*a* may not be tuned over by the rotation of the development roller 35 and only the charged toner can contribute to the development.

In addition to the above-described constituent elements, that is, the development roller 35, the supply roller 133, the guide member 137, and the regulating blade 139, the toner cartridge 30C can include an agitator 141 rotatably installed to transfer the filled toner and a collection member 143 to collect the toner remaining on the development roller 35 after the toner is transferred to the development roller 35.

Although, in the above description, the optimal specifications and arrangements of the development roller 35, the supply roller 133, and the regulating blade 139 of the toner cartridge 30C for the cyan C color, for example, are described, but the present general inventive concept is not limited thereto and can be applied to each of the toner cartridges 30M, 30Y, and 30K for the magenta (M), yellow (Y), and black (K) colors, respectively.

Figure 6:
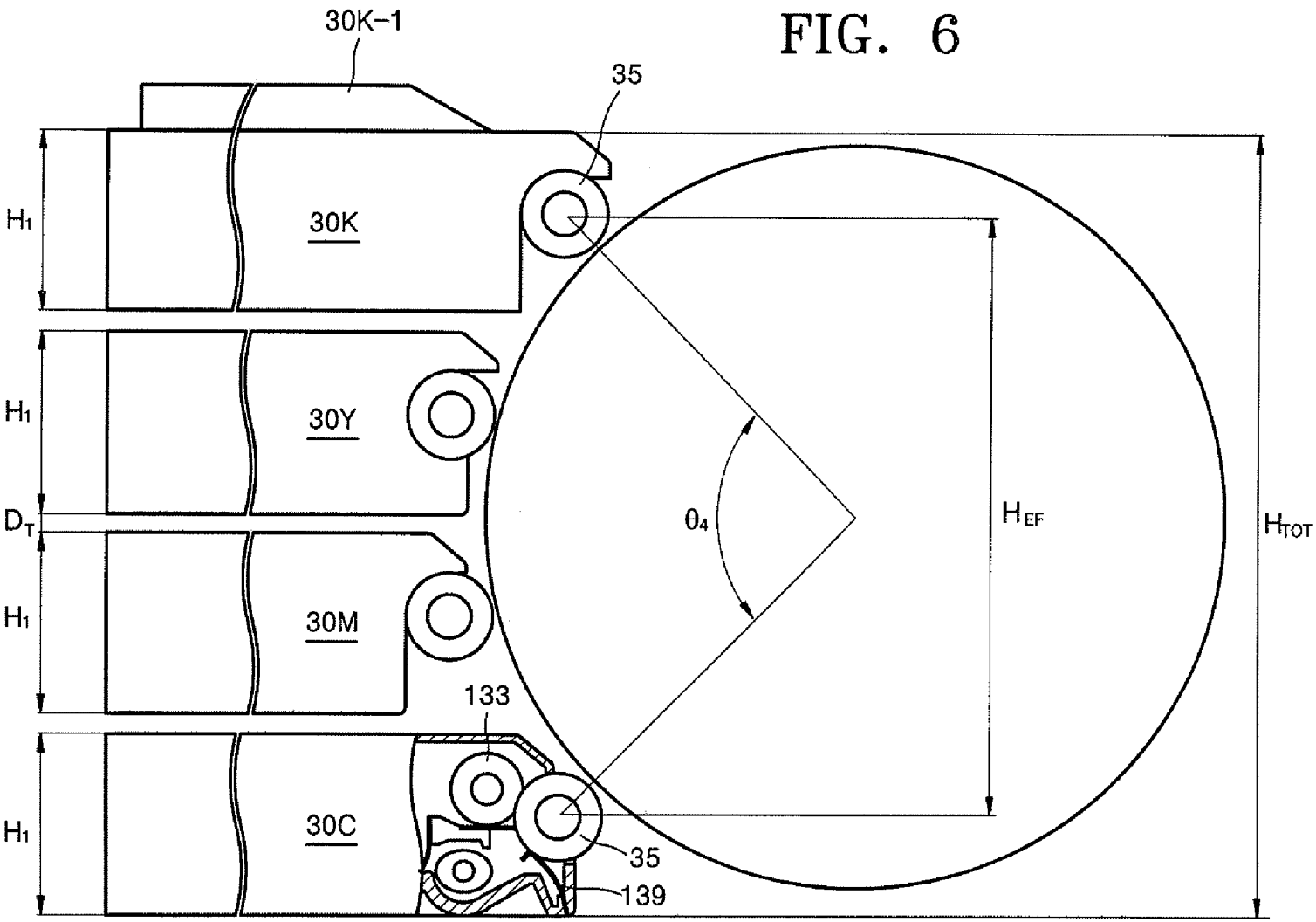
FIG. 6 is a view illustrating the arrangement of the four toner cartridges with respect to a photosensitive drum according to another embodiment of the present general inventive concept.

Referring to FIG. 6, the height of each toner cartridge, the effective height of the entire toner cartridges 30K, 30Y, 30M, and 30C, and the arrangement of the photoreceptor drum 20 are described below.

In an aspect of the present general inventive concept, when a height $H_1$ of each toner cartridge 30K, 30Y, 30M, or 30C is determined based on the cyan color toner cartridge 30C, the height $H_1$ of the toner cartridge 30C refers to a height of the housing 131. The minimum height thereof can be determined by the development roller 35, the diameter and arrangement of the supply roller 133, and the length and arrangement of the regulating blade 139.

When the specification of the toner cartridge 30C is set based on Inequalities 1 through 5, the height $H_1$ of each of the toner cartridges 30C, 30M, 30Y, and 30K can be at least 26 mm.

Considering a thickness of a frame forming the housing 131, a seal bracket 142, and the arrangement of the collection member 143, the height $H_1$ of each of the toner cartridges 30C, 30M, 30Y, and 30K may have a value of 31 mm. In a case of the black color toner cartridge 30K, the height can be set to 31 mm or more, for example, 33 mm, since no toner cartridge is arranged or disposed thereon.

The height $H_1$ of the toner cartridge 30C, 30M, 30Y, or 30K can be freely designed to have a value over the above value. However, as the height $H_1$ increases, it is necessary to increase the diameter of the photoreceptor drum 20. Accordingly, a size of a printer main body increases, a printer is prevented to be compact and manufactured at a low cost.

The toner cartridges 30C, 30M, 30Y, and 30K can be installed in the horizontal direction and can have a structure of being stacked in layers in the vertical direction. The respective toner cartridges 30C, 30M, 30Y, and 30K can be separated from one another with a predetermined gap $D_T$. The gap $D_T$ between the toner cartridges 30C, 30M, 30Y, and 30K may be maintained 1.6 through 1.7 mm and at a minimum of 1.0 mm according to mechanical allowance of each of the toner cartridges 30C, 30M, 30Y, and 30K, thereby securing a space needed for a horizontal slide movement of each toner cartridge 30C, 30M, 30Y, or 30K and a final coupling direction of each development roller 35.

The final coupling direction of the development roller 35 can be determined such that the center of each of the development rollers 35 of the toner cartridges 30C, 30M, 30Y, and 30K moves toward the center of the photoreceptor drum 20. That is, coupling of an uppermost toner cartridge, for example, the black color toner cartridge 30K, can be completed as it moves a fine distance downward at a point where the horizontal slide movement finishes. Meanwhile, coupling of a lowermost toner cartridge, for example, the cyan color toner cartridge 30C, can also be completed as it moves a fine distance upward at a point where the horizontal slide movement finishes. To this end, the gap $D_T$ within the above range can be required between the toner cartridges 30C, 30M, 30Y, and 30K.

Thus, when the height $H_1$ of each of the toner cartridges 30C, 30M, 30Y, and 30K is set to 31 mm and the gap $D_T$ is set to 1.6 mm, a height $H_{TOT}$ of the entire toner cartridges 30C, 30M, 30Y, and 30K can be maintained to be 128.8 mm. When the height $H_1$ of each of the toner cartridges 30C, 30M, 30Y, and 30K is set to 26 mm and the gap $D_T$ is set to 1.0 mm, the height $H_{TOT}$ of the entire toner cartridges 30C, 30M, 30Y, and 30K can be maintained at the minimum of 107 mm.

The black color toner cartridge 30K can be arranged at a top portion of the toner supply unit 30 and may have a sub-space portion 30K-1 at at least a part of an upper surface of the housing 131 to be capable of containing a large amount of black toner compared to the amount of the toner filled in other toner cartridges 30C, 30M, and 30Y. The sub-space portion 30K-1 can be provided to avoid an interference between an upper surface of the development roller 35 and other parts of the printer, for example, the transfer belt 27 of FIG. 1, when being horizontally installed.

The height $H_{TOT}$ of the entire four toner cartridges 30C, 30M, 30Y, and 30K may have a value not more than 135 mm. Also, the effective height $H_{EF}$ from the center of the development roller 35 of the uppermost toner cartridge 30K to the center of the development roller 35 of the lowermost toner cartridge 30C may have a value not more than 98.1 mm. The values are needed to manage the size of the entire printer and the diameter of the photoreceptor drum 20 within Inequalities 1 and 2 and to satisfy the conditions of Inequality 6.

In reviewing the arrangement of the four toner cartridges 30C, 30M, 30Y, and 30K with respect to the photoreceptor drum 20 according to this embodiment of the present general inventive concept, an angle $\theta_4$ (hereinafter, referred to as a radiation angle) formed between a line connecting the center of the development roller 35 of the uppermost toner cartridge 30K and the center of the photoreceptor drum 20 and a line connecting the center of the development roller 35 of the lowermost toner cartridge 30C and the center of the photoreceptor drum 20, can satisfy the conditions of Inequality 6. The radiation angle $\theta_4$ may be about 94°.

$$90° \leqq \theta_4 \leqq 98° \qquad \text{[Inequality 6]}$$

By setting the radiation angle $\theta_4$ as above, since the all toner cartridges 30C, 30M, 30Y, and 30K can be arranged at one side of the photoreceptor drum 20, that is, at the left side of the photoreceptor drum 20 as shown in FIG. 6, the toner cartridges 30C, 30M, 30Y, and 30K can be conveniently replaced. Also, a compact arrangement of the toner cartridges 30C, 30M, 30Y, and 30K can be realized.

When the value of the radiation angle $\theta_4$ is out of a lower limit value of Inequality 6, the toner cartridges 30C, 30M, 30Y, and 30K having the above specifications cannot be arranged while securing the gap $D_T$. When the value of the radiation angle $\theta_4$ is out of the upper limit value of Inequality 6, a position where the development gap $D_g$ is formed for each toner cartridge 30C, 30M, 30Y, or 30K can be changed. Accordingly, not all of the toner cartridges can have the same installation angle as the installation angle $\theta_2$ of the supply roller 133 with respect to the development roller 35. Nor can all of the toner cartridges have the same installation angle as the installation angle $\theta_3$ of the regulating blade 139.

Figure 7:
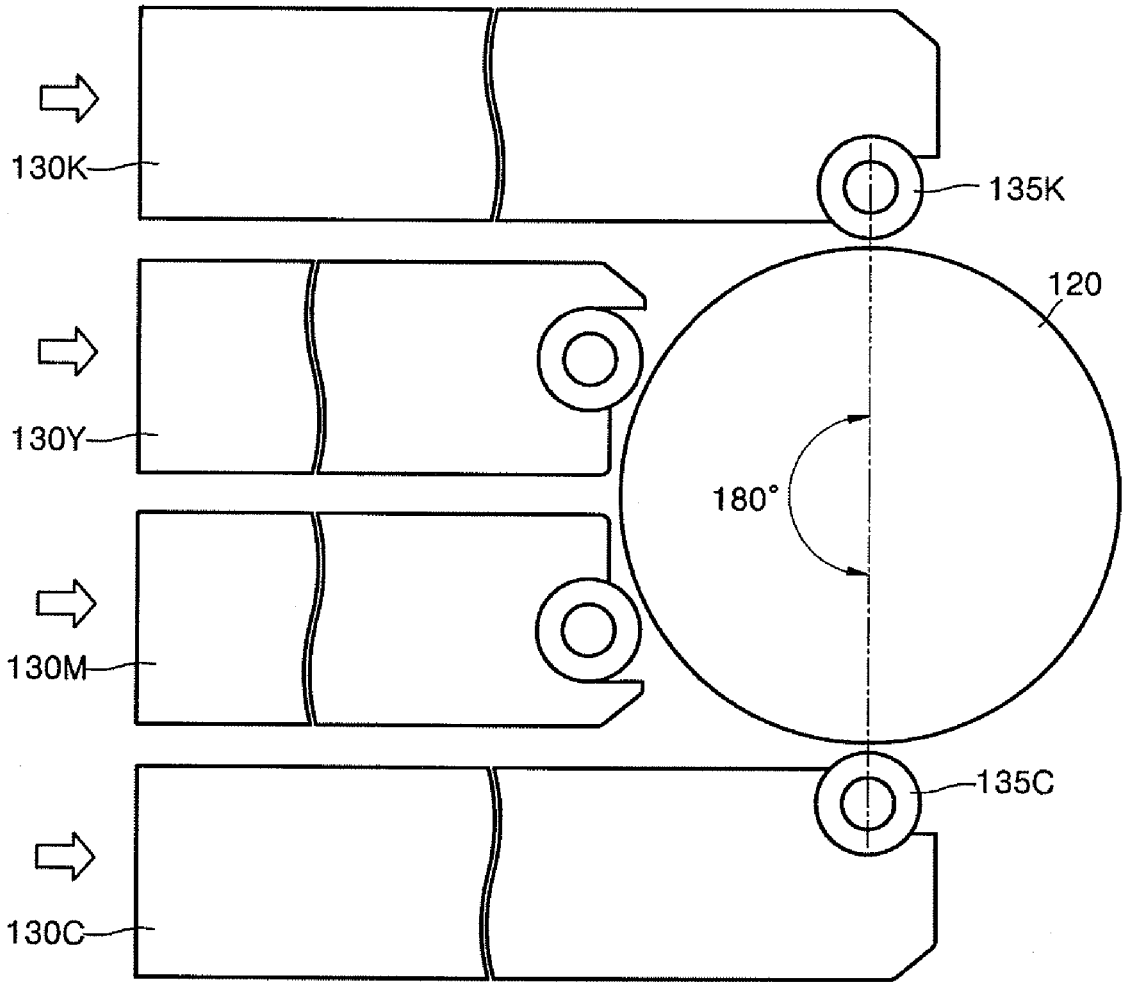
FIG. 7 is a view illustrating the arrangement of the four toner cartridges with respect to a photosensitive drum according to another embodiment of the present general inventive concept.

Referring to FIG. 7, an arrangement angle (radiation angle) $\theta_4$ can be changed according to another embodiment of the present general inventive concept such that respective four toner cartridges 130C, 130M, 130Y, and 130K are arranged at one side of the photoreceptor drum 120, that is, at the left side of the photoreceptor drum 120 in FIG. 7.

That is, the angle $\theta_4$ formed by a line connecting a center of a development roller 135 (135 K) of an uppermost toner cartridge 130K and a center of a photoreceptor drum 120 and a line connecting a center of the development roller 135 (135 C) of a lowermost toner cartridge 130C and the center of the photoreceptor drum 120 can be set to be within 180°.

In this case, in particular, when the angle $\theta_4$ is designed between 100° and 180°, it is a demerit that the arrangement of inner constituent elements of each toner cartridge 130K, 130Y, 130M, or 130C may be differently designed. However, it is advantageous that, while each of the toner cartridges 130C, 130M, 130Y, and 130K is horizontally installed, the replacement of the toner cartridge is convenient since they can be replaced at one side of the printer. Also, the height of the toner cartridge can be set relatively freely than setting the height of the entire toner cartridges described with reference to FIG. 6. A relatively large inner space of the housing to contain the toner can be secured.

As described above, in the above toner cartridge according to the present general inventive concept, since the diameter of the development roller, an angle of an opening portion of the development roller, the diameter of the supply roller, the arrangement position of the supply roller with respect to the development roller, the length of the free end of the regulating blade, the arrangement position of the leading end of the blade, the height of each toner cartridge, and the height of the entire toner cartridges are specified within the limited ranges, the structure of the toner cartridge can be made compact, the number of assembly operations can be reduced, and the manufacturing cost can be lowered.

Also, in the horizontal installation type fixed dry electrophotographic printer adopting the above toner cartridge according to embodiments of the present general inventive concept, since the diameter of the photoreceptor drum and the arrangement of the toner cartridge with respect to the photoreceptor drum are optimized, the print quality can be improved, the entire structure of a printer can become compact, the manufacturing cost can be lowered, and the number of assembly operations can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electrophotographic printer comprising:

a cabinet;

a photoreceptor drum provided in the cabinet and formed with an electrostatic latent image by charging and exposure; and at least four toner cartridges which supplies toner of a predetermined color to the photoreceptor drum in the cabinet, each of the toner cartridges including a development roller which is arranged to face the photoreceptor drum to develop an image, the at least four toner cartridges being arranged in parallel to each other, wherein an angle formed between a line connecting a center of the development roller of the toner cartridge disposed at an uppermost side and a center of the photoreceptor drum and a line connecting a center of the development roller of the toner cartridge disposed at an lowermost side and the center of the photoreceptor drum is $\theta_4$, and the angle $\theta_4$ satisfies an inequality that $90° < \theta_4 \leqq 180°$.

2. The electrophotographic printer as claimed in claim 1, wherein the angle $\theta_4$ satisfies an inequality that $90° < \theta_4 \leqq 98°$.

3. The electrophotographic printer as claimed in claim 1, wherein, when a height of each of the toner cartridges is $H_1$, the height $H_1$ satisfies an inequality that $26 \leqq H_1 \leqq 33$ mm.

4. The electrophotographic printer as claimed in claim 1, wherein the toner cartridges are stacked in layers while being separated by a predetermined gap $D_T$ and are to supply toner of cyan (C), magenta (M), yellow (Y), and black (K) colors, and a total height between an upper surface of the toner cartridges disposed at an uppermost side of the four toner cartridges and a lower surface of the toner cartridge disposed at the lowermost side in a vertical direction thereof has a value not more than 135 mm.

5. The electrophotographic printer as claimed in claim 4, wherein the gap $D_T$ satisfies an inequality that $1.0 \leqq D_T \leqq 1.7$ mm.

6. The electrophotographic printer as claimed in claim 1, wherein a total effective height from the center of the development roller of the toner cartridge disposed at an uppermost side to the center of the development roller of the toner cartridge disposed at a lowermost side in a vertical direction has a value not more than 98.1 mm.

7. The electrophotographic printer as claimed in claim 1, wherein the at least four toner cartridges are installed horizontally in the cabinet, and wherein, when a diameter of the photoreceptor drum is $D_1$, the diameter $D_1$ satisfies an inequality that $116 \leqq D_1 \leqq 130$ mm.

8. The electrophotographic printer as claimed in claim 7, wherein, when a diameter of the development roller is $D_2$, a relationship between the diameters $D_1$ and $D_2$ satisfies an inequality that $0.08 \leqq D_2/D_1 \leqq 0.17$.

9. The electrophotographic printer as claimed in claim 7, wherein an opening angle $\theta_1$ of the development roller satisfies an approximate equation that $22° \leqq \theta_1 \leqq 28°$, and the opening angle $\theta_1$ of the development roller is an angle formed between line connecting a center of the development roller and a leading end of a development gap formed between the development roller and the photoreceptor drum and a line connecting the center of the development roller and a trailing end of the development gap.

10. The electrophotographic printer claimed in claim 1, wherein:

the photoreceptor drum has a first diameter; and the development roller has a second diameter and has a ratio with the first diameter between 0.08 and 0.17 inclusive.

11. The electrophotographic printer as claimed in claim 10, wherein:

the at least four toner cartridges comprises a first, a second, a third, and a fourth toner cartridges having a first, a second, a third, and a fourth development rollers, respectively, and the first, the second, the third, and the fourth toner cartridges are disposed around the photoreceptor drum sequentially, wherein centers of the first development roller and the fourth development roller are disposed on a line passing through a center of the photoreceptor drum.

12. The electrophotographic printer as claimed in claim 11, wherein a second line passing through centers of the second and third development rollers is parallel to the line passing through the center of the photoreceptor drum and the centers of the first development roller and the fourth development roller.

13. The electrophotographic printer as claimed in claim 11, wherein each of the first, second, third, and fourth development rollers forms a development gap in a tangential direction with the photoreceptor drum, a length of the development gap is disposed within an angle from a center of the corresponding development roller, and the angle is between 22° and 28° inclusive.

14. The electrophotographic printer as claimed in claim 10, wherein:

the at least four toner cartridges comprises a first, second, a third, and a fourth toner cartridges having a first, second, a third, and a fourth development rollers, respectively, and the first, the second, the third, and the fourth toner cartridges are disposed around the photoreceptor drum sequentially, wherein a distance between centers of the first development roller and the fourth development roller is less than a diameter of the photoreceptor drum.

15. The electrophotographic printer as claimed in claim 10, wherein the at least four toner cartridges comprises a first, a second, a third, and a fourth toner cartridges disposed round the photoreceptor drum, sequentially, wherein a thickness of first the toner cartridge is greater then those of the second, third, and fourth toner cartridges.

16. The electrophotographic printer as claimed in claim 15, wherein the second, third, and fourth toner cartridges have the same thickness.

17. The electrophotographic printer as claimed in claim 15, wherein the first toner cartridge comprises a black toner cartridge, and the second, third, and fourth toner cartridges comprise cartridges containing color toners other than black toner.

18. The electrophotographic printer as claimed in claim 1, wherein the at least four toner cartridges are arranged in a state of being fixedly coupled to the cabinet.

* * * * *